United States Patent [19]

Driscoll

[11] Patent Number: 4,801,841

[45] Date of Patent: Jan. 31, 1989

[54] GAS DISCHARGE LAMP WITH BUILT-IN RESISTANCE TO COLOR CENTER FORMATION IN ULTRAVIOLET-TRANSMISSIVE WINDOW

[75] Inventor: John N. Driscoll, Wellesley, Mass.

[73] Assignee: HNU Systems, Inc., Newton, Mass.

[21] Appl. No.: 171,182

[22] Filed: Mar. 18, 1988

Related U.S. Application Data

[63] Continuation of Ser. No. 79,752, Jul. 30, 1987, abandoned.

[51] Int. Cl.[4] ..... H01J 61/067; H01J 61/10; H01J 61/40

[52] U.S. Cl. ..... 313/112; 313/574; 313/576; 313/611; 313/619

[58] Field of Search ..... 313/112, 574, 575, 576, 313/611, 618, 619

[56] References Cited

U.S. PATENT DOCUMENTS

| | | | |
|---|---|---|---|
| 1,954,958 | 4/1934 | Smythe | 313/619 |
| 2,004,587 | 6/1935 | Schröter | 313/618 X |
| 3,374,383 | 3/1968 | Bergen et al. | 313/112 X |
| 4,199,703 | 4/1980 | Samson | 313/611 |

OTHER PUBLICATIONS

Warneck, Peter, "LiF Color-Center Formation and uv Transmission Losses from Argon and Hydrogen Discharges", *Journal of the Optical Society of America*, Aug. 1965, vol. 55, No. 8, pp. 921–925.

Kittel, Charles, "Introduction to Solid State Physics", Wiley, 2 ed., pp. 491–497.

Samson, J. A. R., "Crystalline Materials", *Tech. Vac. U.V. Spectroscopy*, pp. 183–184, chapter 6, (Filter and Window Materials), Wiley, New York, 1967.

Warneck, Peter, "A Microwave-Powered Hydrogen Lamp for Vacuum Ultraviolet Photochemical Research", *Applied Optics*, Nov. 1962, vol. 1, No. 6, pp. 721–726.

Laufer, A. H. and McNesby, J. R., "Photolysis of Ethane at the Argon Resonance Lines 1067 and 1048A", *J. Chem. Phys.*, p. 3329.

Lane, Arthur L. and Kuppermann, Aron, "Argon Resonance Line Lamp for Vacuum Ultraviolet Photochemistry", pp. 126–127.

McNesby, J. et al., 1971, pp. 548–551, "Vacuum Ultraviolet Techniques in Photochemistry".

Schneider, E. G., "The Effect of Irradiation on the Transmission of Lithium Fluoride", *J. Optical Soc. America*, vol. 27, pp. 72–74, (1937).

*Primary Examiner*—Palmer C. DeMeo

[57] ABSTRACT

A gas discharge lamp for emitting vacuum UV radiation, comprising a lamp body filled at low pressure with a gas capable of emitting radiation in the vacuum UV range (e.g., argon), electrodes within the lamp body for passing an electric field across the gas, a crystalline window (e.g., lithium fluoride) in the body for transmitting the vacuum UV radiation emitted by the gas, wherein the crystalline window is constructed of a material that, when exposed to the vacuum UV radiation emitted by the gas, forms color centers that block transmission of the radiation through the window, and a bleaching element located within the lamp body for emitting color-center bleaching radiation in response to the electric field degrading emission of the vacuum UV radiation, the bleaching radiation being in a frequency band (e.g., 5–6 eV) lower than the vacuum UV radiation.

11 Claims, 1 Drawing Sheet

GAS DISCHARGE LAMP WITH BUILT-IN RESISTANCE TO COLOR CENTER FORMATION IN ULTRAVIOLET-TRANSMISSIVE WINDOW

This is a continuation of co-pending application Ser. No. 079,752, filed on July 30, 1987, and now abandoned.

BACKGROUND OF THE INVENTION

The invention relates to lamps for producing vacuum UV radiation, such as used in photoionization detection.

There is a need in photoionization detection to provide short wavelength (so called "vacuum") ultraviolet radiation, for detecting low-molecular-weight compounds (which have high ionization potentials). Typically, an argon-filled lamp is used, as it provides 11.6 and 11.8 eV emission lines. Such short-wavelength radiation will not pass through the glass walls of the lamp, and thus it is customary to use a lithium fluoride crystal as a transmission window. A persistent difficulty with such windows has been that they develop what are known as color centers, which absorb radiation in the vacuum UV range emitted by the lamp. This result in the windows rather rapidly becoming opaque to the vacuum UV radiation, greatly shortening the useful lives of the lamps (e.g., a 10.2 eV lamp that does not suffer from color center formation may have a useful life 100 times that of an 11.6 and 11.8 eV argon lamp with a lithium fluoride window).

This color center problem has received considerable attention in the published literature for more than two decades. E.g., Warnek, Peter, "LiF Color-Center Formation and uv Transmission Losses from Argon and Hydrogen Discharges", *Journal of the Optical Society of America,* August 1985, Volume 55, Number 8, pp. 921–925; Kittel, Charles, "Introduction to Solid State Physics", Wiley, 2 ed., pp. 491–497; Sampson, J. A. R., "Crystalline Materials", *Tech. Vac. U.V.,* pp. 183–184 (published approximately 1965); McNesby, J., et al., "Vacuum Ultraviolet Techniques in Photochemistry", 1971, pp. 548–551; Warnek, Peter, "A Microwave Powered Hydrogen Lamp for Vacuum Ultraviolet Photochemical Research", *Applied Optics,* November 1962, Vol. 1, No. 6, pp. 721–726; Laufer, A. H. and McNesby, J. R., "Photolysis of Ethane at the Argon Resonance Lines 1067 and 1048A", *J. Chem. Phys.,* p. 3329; Lane, Arthur L. and Kuppermann, Aron, "Argon Resonance Line Lamp for Vacuum Ultraviolet Photochemistry", pp. 126–127. Some of these publications offer suggestions for bleaching the color centers or otherwise restoring transmittancy: polishing (Sampson); exposure to a mercury lamp for a number of hours (McNesby et al.); bleaching by illumination with light absorbed in the F band (5 eV for lithium fluoride) (Kittel); heating at 350° C. for about twelve hours (Laufer et al.). The present inventor several years ago considered adding mercury vapor to the argon, in an effort to retard color-center formation, but found that the mercury unduly degraded the 11.6 and 11.8 eV emission of argon.

SUMMARY OF THE INVENTION

In general the invention features bleaching the color centers during lamp operation by locating within the lamp an element emitting radiation in a frequency range that bleaches the centers and that does not degrade the desired vacuum UV emission. In preferred embodiments, the lamp is filled with argon to provide 11.6 and 11.8 eV emission lines, the window is lithium fluoride, and the element emitting the bleaching radiation is a metallic member (e.g., a cylindrical tube) positioned in the plasma at the center of the lamp. The invention provides a simple, low-cost way of increasing the useful life of vacuum UV lamps. For example, addition of the metallic member to an argon lamp with a lithium fluoride window increased the useful life of the lamp from about 100–200 hours to 500–700 hours, more than a 300% improvement.

Other features and advantages of the invention will be apparent from the following description of a preferred embodiment and from the claims.

DESCRIPTION OF A PREFERRED EMBODIMENT

Figure 1:
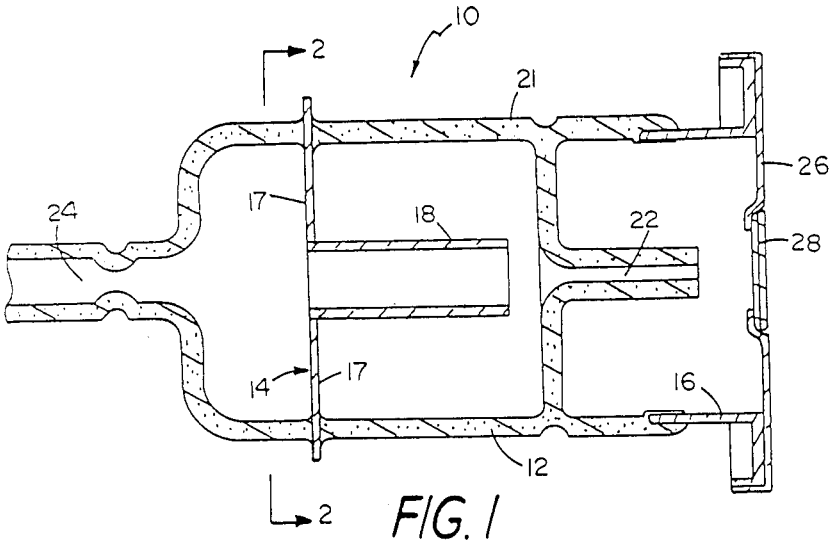
FIG. 1 is a sectional view through a preferred embodiment of the invention.

A gas discharge lamp 10 is shown in FIG. 1.

Figure 2:
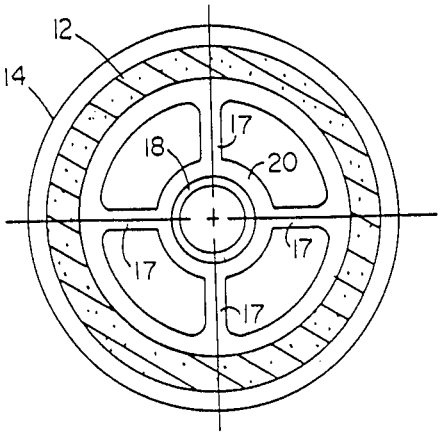
FIG. 2 is a partial sectional view taken at 2—2 in FIG. 1.

The lamp consists of a cylindrical glass body 12 to which are sealed two electrodes 14, 16 (Kovar alloy). Four radially-extending ribs 17 of electrode 14 (FIG. 2) extend inwardly to support metallic member 18, a cylindrical tube of nickel (approximately 0.25 inch in diameter, 0.75 inches in length) welded to central hub 20 of the electrode and concentric with the cylindrical walls 21 of the lamp body. Capillary 22 is formed in the glass body, and aligned concentrically with cylindrical walls 21. The lamp is evacuated and filled at low pressure with argon gas through opening 24, which is then sealed. A metal plate 26 welded to electrode 16 supports a window 28 (lithium fluoride crystal), which is bonded to the metal plate. The radiation emitted by the argon is transmitted through this window.

In operation, the electric field generated between electrodes 14, 16 causes the argon to emit radiation at 11.6 and 11.8 eV (emission lines at 1048 and 1066 Angstroms). The presence of the metallic member 18 in the plasma at the center of the lamp produces a second emission at approximately 5–6 eV. These two emissions work at cross purposes with respect to formation of color centers in the lithium fluoride window. The 11.6 and 11.8 eV radiation tends to form such centers, while the 5–6 eV radiation tends to bleach them. In this embodiment, the bleaching action is not sufficiently strong to stop formation of the color centers, but does substantially slow their formation.

The capillary 22, and to some extent the cylindrical shape of metallic member 18, contribute to collimating and intensifying the 11.6 and 11.8 eV radiation emitted by the lamp.

Other embodiments are within the scope of the claims. For example, almost any shape or type of metal member will produce the desired 5–6 eV radiation; other gases and crystalline window combinations that produce color centers can take advantage of the invention to retard such production; other sources of bleaching radiation (i.e., 5–6 eV in the case of lithium fluoride) can be provided, with the only restriction being that they not interfere with emission of the desired vacuum UV radiation; an alternative source is a salt (e.g., glass doped with salt), which can supply the metallic ions that produce the desired bleaching radiation; other lamp configurations than the one shown can be improved by incorporating the invention.

I claim:

1. A gas discharge lamp for emitting vacuum UV radiation, comprising a lamp body filled at low pressure with a gas capable of emitting radiation in the vacuum UV range, means for initiating a discharge in said gas, a crystalline window in said body for transmitting the vacuum UV radiation emitted by said gas, wherein said crystalline window is constructed of a material that, when exposed to the vacuum UV radiation emitted by said gas, forms color centers that block transmission of said radiation through said window, and bleaching means located within said lamp body for emitting color-center bleaching radiation without degrading emission of said vacuum UV radiation, said bleaching radiation being in a frequency band lower than said vacuum UV radiation.

2. The gas discharge lamp of claim 1 wherein said means for initiating a discharge in said gas comprises electrodes within the lamp body for passing an electric field across said gas.

3. The gas discharge lamp of claim 2 wherein said crystalline window is lithium fluoride.

4. The gas discharge lamp of claim 3 wherein said gas is argon and said vacuum UV radiation comprises emission lines at 11.6 and 11.8 eV.

5. The gas discharge lamp of claim 3 wherein said bleaching radiation comprises radiation with emission lines in the vicinity of 5–6 eV.

6. The gas discharge lamp of claim 4 wherein said bleaching radiation comprises radiation with emission lines in the vicinity of 5–6 eV.

7. The gas discharge lamp of claim 6 wherein said bleaching means comprises a member having metallic ions and means for supporting said member within said lamp body at a location at which said metallic ions will emit said bleaching radiation.

8. The gas discharge lamp of claim 7 wherein said member comprises metal.

9. The gas discharge lamp of claim 8 wherein said lamp body is cylindrical and elongated along a central axis and said electrodes are positioned and sized so that a plasma field is created in said gas along said axis, and wherein said metallic member is positioned along said axis within said plasma field.

10. The gas discharge lamp of claim 9 wherein said metallic member is a cylindrical tube.

11. The gas discharge lamp of claim 7 wherein said lamp body includes a capillary passage along an axis normal to said window and adjacent thereto for collimating and intensifying said vacuum UV radiation.

* * * * *